United States Patent [19]

Wile et al.

[11] Patent Number: 4,517,893

[45] Date of Patent: May 21, 1985

[54] SILK SCREEN PRINTING WITH THE CURING OF POLYMERIZABLE LIQUIDS

[75] Inventors: George J. Wile, Indian Hill; Carl P. Griesdorn, Cincinnati, both of Ohio

[73] Assignee: Planet Products Corporation, Cincinnati, Ohio

[21] Appl. No.: 607,979

[22] Filed: May 7, 1984

Related U.S. Application Data

[63] Continuation of Ser. No. 402,616, Jul. 28, 1982, abandoned.

[51] Int. Cl.[3] ..... B41L 13/02

[52] U.S. Cl. ..... 101/123; 101/126; 219/216; 219/343; 250/504 R

[58] Field of Search ..... 101/126, 123; 250/504 R; 219/216, 342, 343

[56] References Cited

U.S. PATENT DOCUMENTS

| | | | |
|---|---|---|---|
| 1,589,338 | 6/1926 | White | 250/504 |
| 1,715,634 | 6/1929 | Barrett | 250/504 |
| 2,530,484 | 11/1950 | Schmidt | 101/123 |
| 2,612,835 | 10/1952 | Marek | 101/126 |
| 2,615,120 | 10/1952 | Macksoud | 250/504 |
| 3,120,599 | 2/1964 | Hilgers | 219/342 |
| 3,331,941 | 7/1967 | Edwards | 250/504 |
| 3,413,441 | 11/1968 | Isobe | 250/504 |
| 3,445,662 | 5/1969 | Langley | 250/504 |
| 3,525,303 | 6/1970 | Cummings | 101/123 |
| 3,585,390 | 6/1971 | Ishikawa | 250/504 |
| 3,699,885 | 10/1972 | Thierstein | 101/126 |
| 3,720,162 | 3/1973 | James | 101/126 |
| 3,752,070 | 8/1973 | Jaffa | 101/123 |
| 3,757,081 | 9/1973 | Smith | 219/216 |
| 3,795,189 | 3/1974 | Jaffa | 101/126 |
| 3,854,398 | 12/1974 | Martin | 101/126 |
| 3,886,864 | 6/1975 | Larsson | 101/126 |
| 4,064,402 | 12/1977 | Posnasky | 250/504 |
| 4,091,726 | 5/1978 | Walker | 101/126 |
| 4,271,363 | 6/1981 | Anderson | 250/504 |
| 4,273,042 | 6/1981 | Machida | 101/123 |

FOREIGN PATENT DOCUMENTS

| | | | |
|---|---|---|---|
| 582239 | 9/1958 | Italy | 101/123 |

*Primary Examiner*—Clyde I. Coughenour
*Attorney, Agent, or Firm*—Kinney and Schenk

[57] ABSTRACT

Apparatus is disclosed for the production of silk screened textile goods. Workpieces are positioned on pedestals of a conveyor at a printing station and a silk screen design is then printed thereon. Cyclical operation of the conveyor incrementally advances the printed workpieces to a "drying" station where the printed designs is converted to solid form. The ink employed is plastisol based and is converted or "dried" to solid form primarily through polymerization. The "drying" station employs a heater element which selectively emits infra-red radiation spectrally limited to a wavelength range of three to four microns, a wavelength range at which the liquid plastisol exhibits a peak of radiation absorption. Operation of the conveyor is responsive to the rate at which an operator silk screens the workpieces with means being provided to retract the heater element from its operative position if this rate falls below a predetermined pace in order to avoid over exposure of the workpiece to the infra-red radiation. The plastisol inks are "dried" in significantly reduced times with the energy requirements being greatly minimized. Similar advantages can be attained in "drying" other polymerizable liquids by employing infra-red radiation which is spectrally limited to a wavelength range at which the liquid exhibits a peak of radiation absorption.

18 Claims, 12 Drawing Figures

134
136
138
R-4-1
56
R-2-1a
104a
R-2-1b
104b
140
156
144
160
R-3
142
R-3-1
R-4
R-5-1
168
58
102
162
R-5-2
122
R-5
R-6
170
R-6-1
150
146
172
151a
R-1-1a
R-2a
154a
152a
R-1a
151b
R-1-1b
R-2b
154b
152b
R-1b

SILK SCREEN PRINTING WITH THE CURING OF POLYMERIZABLE LIQUIDS

This is a continuation of application Ser. No. 402,616, filed July 28, 1982, now abandoned.

The present invention relates to improvements in the "drying" of silk screen prints on textile goods and more broadly, and properly, to curing, or polymerizing, liquid monomers and polymers to a solid form.

Motivation for the present invention comes from the peculiar needs of the silk screen printing industry, as it is involved in producing textile goods having various types of designs printed thereon. Perhaps the most common and familiar product of this type are T-shirts having school emblems, slogans and other designs printed thereon.

Today, and for some time past, the inks employed for such silk screen printing are compounded from a resinous, liquid polymers or co-polymer base to which is added dies and/or pigments for a desired color and plasticizers and thinners, all of which are well known to those skilled in the compounding art. Such inks, when "dried" in printed form on a textile form a tough, rubber-like film which can stretch with the fabric without losing its adhesion and has the further desirable quality of being able to withstand repeated washing cycles. These inks, commonly referenced as plastisol inks, have, to a great extent, replaced earlier inks in which the binder for adhering the pigment of the ink was carried in a liquid solution.

This loads to the term "drying" being set forth in quotation marks, since, in the case of plastisol based inks, where is only a markedly evaporation of liquid in obtaining the solid film which is printed on the textile product. Instead, the liquid base polymerizes to form the solid film which binds the pigment to the fabric, a process commonly referenced as curing. In the case of plastisols, the curing process has been commonly accepted as a time/temperature function, in the same sense that the drying of solvent based inks is likewise a time/temperature function.

Silk screen printing on textiles is a well known, if not antique, process and requires no specific description at this point. Suffice it to say that when the advantages of plastisol inks were recognized some several years ago, there was little or no modification of existing methods or equipment in tranitioning from the earlier solvent based inks.

Over the years there have been many efforts to increase productivity by automating the printing step and by increasing the "drying" temperature. The "drying" step, however, has remained a limiting factor which has been aggravated by the relatively recent introduction of synthetic textiles, such as polyesters, which tend to melt at a lower temperature than at which cotton goods would be scorched.

Present state of the art driers are, for the most part, either gas fired or conventional infra-red, electrical resistance heating elements, both of which require a "drying" cycle time in order of two minutes, and usually much longer, despite temperatures being generated which are in excess of 1500° F. Such conventional driers, particularly where high production rates are sought, occupy large amounts of floor space and involve substantial capital investment. They further require auxiliary equipment for the disappation of the excess heat generated. The conventional driers are inefficient and with the ever increasing costs for energy, this inefficiency becomes a significant economic factor.

The adverse economics of high volume silk screen printing is further demonstrated by the failure of that industry to employ "in-line" or through flow techniques. The great disparity between the printing cycle time of five seconds or less and the drying cycle time of two minutes or more, results in a batch type of operation since the length and expense of a drier to match the output of a single printer would be too great for any practical consideration.

While the present invention seeks to overcome the limitations of excessive time in "drying" silk screen designs printed on textiles, and many of its specific aspects are limited to that art, such excessive "drying" times are significant in many other fields.

Exemplary of this is the art of electronic printed circuitry, where plastisol inks are printed on boards and then "dried" to permit the formation of a given circuit in combination with other electronic components mounted on the board.

In the printing industry, as in a rotary press operation, conventional solvent based inks require elaborate precautions to prevent contamination of the atmosphere. Plastisol based inks could greatly minimize the contamination problem, but their use is precluded, economically, by the length of "drying" time required.

Another example is found in the use of single component epoxy glues which are employed to bond a wide range of components. The time/temperature factor required to convert such a glue to a solid form, wherein its bonding properties are developed, becomes a limiting factor in the use of such glues or an added expense in its use.

Common to such inks, glues and other formulations is that a liquid monomer, polymer, or co-polymer is desired to be converted to solid form, through polymerization, and that such curing process is time/temperature function.

Accordingly, one object of the present invention is to obtain a substantial reduction in the cycle time required to "dry" silk screened designs printed on textile goods, and particularly to do so without damaging the textile goods.

Another object of the present invention is to significantly reduce the energy requirements for "drying" silk screened designs printed on textile goods.

Another object of the present invention is to provide economical equipment for "drying" silk screened designs printed on textile goods and in so doing to reduce the space requirements required for such "drying" equipment.

Another object of the present invention is to increase the rate of production of "dried" silk screen printed textile goods through the provision of a through flow type of machine.

Another object of the present invention is to reduce the space requirements of "driers" for silk screened designs printed on textile goods or the combination of a "dryer" and a printing station, through the provision of a conveyor which reduces the spacing required between textile workpieces.

A further and broader object of the present invention is to reduce the time and energy requirements for curing liquid monomers and co-polymers to a solid form.

A still further object of the present invention is to provide economical and compact equipment for curing liquid monomers, polymers and co-polymers to a solid form.

The objects of reducing the "drying" cycle time for silk screened designs printed on textile goods is predicated on plastisol inks being employed and is obtained through the use of a radiant energy source of thermal radiation having a spectral distribution concentrated in the longer wavelengths of this sector of the electromagnetic spectrum, preferably in the range of three to four microns which matches the wave length range at which the liquid ink exhibits a peak of radiation absorption and thus effectively converts the radiation energy to heat and energy.

In providing this form of radiant energy, an emission panel is spaced from the article on which the silk screen design is printed. The emission panel comprises a metal sheet, the outer surface of which is coated with metallic and non-metallic oxides, preferably black in color. The desired spectral distribution is then obtained by heating the emissive surface to a relatively low temperature, in the order of 600°-1000° F., compared to the much higher temperatures employed in conventional infra-red heaters. The oxide coatings functions as a "window" to limit the energy emitted to the desired three to four micron wavelength range. The drastically reduced "drying" cycle times, further enhanced by the lower operating temperatures of the emissive surface, enable the attainment of the desired ends of reducing energy consumption. This same basic heating element can also be employed in curing or polymerizing other liquid monomers, polymers and co-polymers to convert them to solid form by matching the wavelength range of radiation energy generated to that at which the liquid exhibits an absorption peak.

This heating element is advantageously employed in combination with a conveyor which is powered so as to provide a controlled exposure of the article to the radiant heat energy which is sufficient to "dry" the printed design without damaging the textile goods on which it is printed. High production rates are obtainable through extending the conveyor to a printing station, thereby enabling the article to be positioned on the conveyor where the silk screen design is applied. The conveyor is then cyclicly advanced to convey the printed articles directly to the heating element and then to discharge the articles after the design is "dried".

Such machine which combines the printing and "drying" steps is preferably provided with means for actuating advancement of the conveyor in response to completion of the printing operation, with the further provision of means of displacing the heating element from its operative position in the event that a given printing operation is not completed within the maximum time period which, if exceeded, would cause damage to the textile goods.

The form of conveyor employed in this machine preferably comprises a plurality of pedestals mounted in spaced relation along the length of an endless belt. The upper surface of the pedestal provides a supporting surface for the textile workpiece during the silk screen printing step and then accurately positions the printed design as it is advanced beneath the heating element. Since the area of the upper surface of each pedestal needs only to be as great as the printed design and because of the fact that this portion of the workpiece is held in elevated position, the pedestals can be closed spaced from each other to minimize the overall length of the machine. This feature can also lend itself to use in any "drying" oven to either reduce the required overall length or to increase production.

The above and other related objects and features of the invention will be apparent from a reading of the following description of a prefered embodiment of the invention, with reference to the accompanying drawings and the novelty thereof pointed out in the appended claims.

Figure 1:
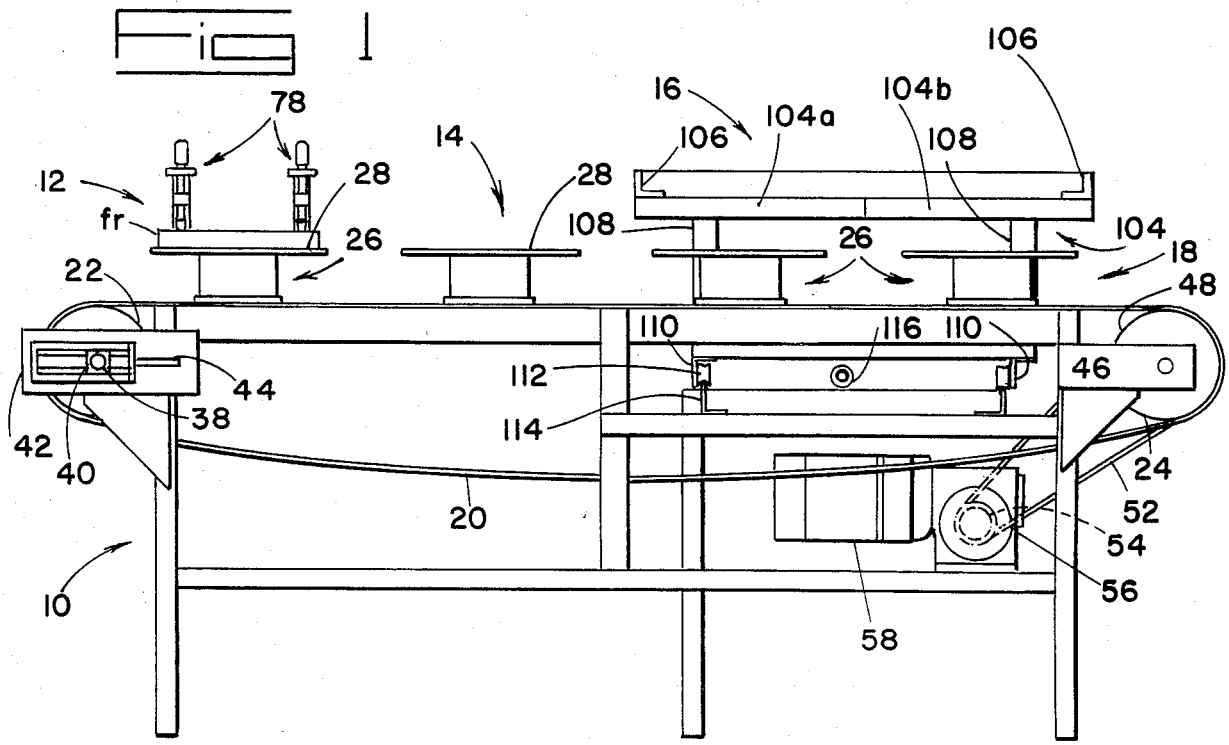
FIG. 1 is a front elevation of an apparatus for producing silk screened textile goods in accordance with the present invention.

The drawings illustrate an apparatus, indicated generally by reference character 10, for the "in-line" production of silk screen printed textile goods. In basic operation, an operator silk screens a design on a workpiece at a printing station 12, the workpiece is then advanced to a holding station 14 and then to a "drying" station 16 from which it is discharged as a finished product, at least so far as the printing operation is concerned.

Progression of workpieces through the apparatus is provided for by a cyclicly operated conveyor 18 which comprises and endless belt 20 trained around pulleys 22 and 24 at opposite ends of the apparatus 10. A plurality of pedestals 26 are mounted in equally spaced relation along the length of the belt 20. Each of the pedestals 26 comprises a workpiece supporting plate 28 (see also FIGS. 3 and 4) positioned in spaced relation above (on the upper run of the conveyor) the belt 20 by an upright 30 secured to a base plate 32.

The base plate 32 is then secured to the belt 20 by a pair of fasteners 34 disposed on a line normal to the path of travel of the belt. It will also be seen that a plate 36 underlies the upper run of the belt 20. These constructional features constrain the pedestals 26, and particularly the workpiece supporting plates 28, to rectilinear, horizontal movement from the printing station 12 through the "drying" station 16, while permitting the pedestals to turn around the pulleys 22 and 24 in their endless path of movement.

The pulley 22 is mounted on a shaft 38 which is journaled in blocks 40 which are slidable in horizontal guideways formed in frame members 42 and adjustable therein, by means of screws 44 to properly tension and track the belt 20. The pulley 24 is mounted on a shaft 46 which is journaled on frame members 48 at the opposite, or discharge, end of the apparatus 10. A pulley 50 is secured to a rearward extension of the shaft 46 and is connected by a V-belt 52 to a pulley 54 secured to the output shaft of a motor 56 which is provided with a solenoid brake 58. Actuation of the motor 56 and brake 58 to obtain incremental advancement of the conveyor 18 will late be described in detail, suffice it for the moment to note that the conveyor 18 is illustrated in a dwell position.

Figure 6:
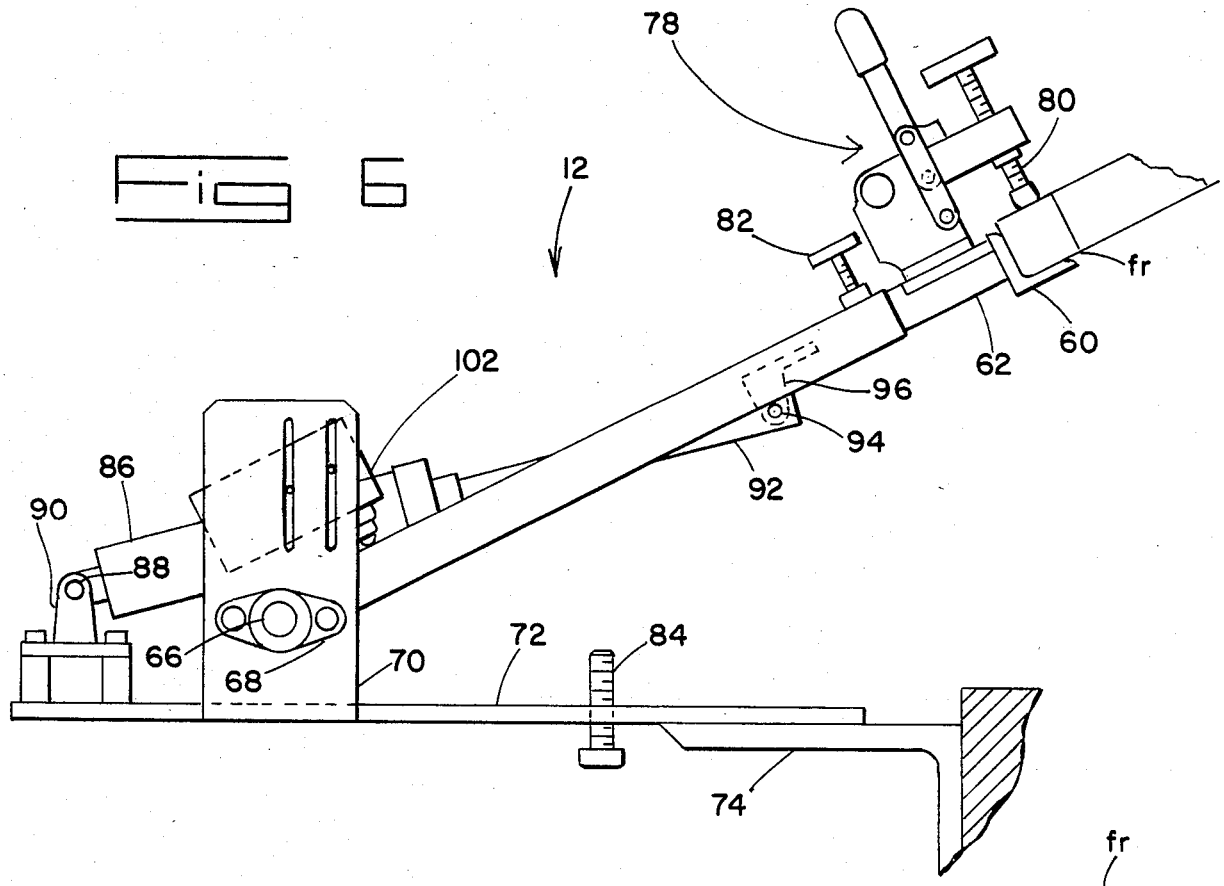
FIG. 6 is a side view, on an enlarged scale, of printing mechanism employed in the present apparatus.
Figure 7:
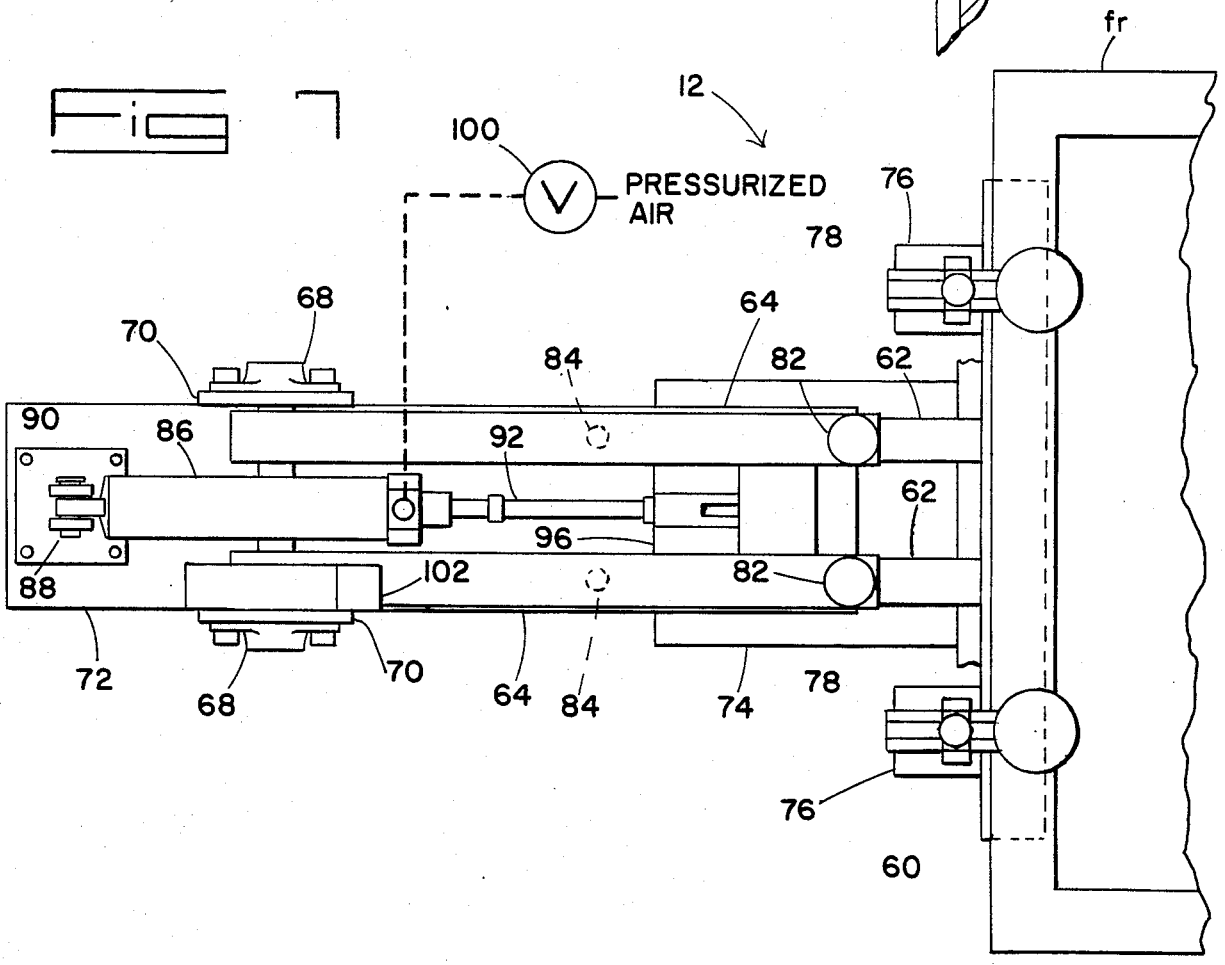
FIG. 7 is a plan view of the printing mechanism seen in FIG. 3.

The printing station 12 will now be described in detail with further reference to FIGS. 6 and 7. It is contemplated that the actual silk screening of a design on a workpiece will be done in accordance with existing practices and techniques. Basically this involves forcing ink through a design cut into a piece of silk screen which is mounted on a wooden frame and held firmly against a workpiece. In the present apparatus a workpiece would be positioned by an operator on the plate 28 of the pedestal 26 at the printing station 12. The operator would then lower a silk screen frame assembly fr against the workpiece and then, using a squeegee, force ink, on the upper surface of the screen, through the design cut therein to print on the workpiece.

The screen frame holding mechanism is disposed on the side of the apparatus opposite where the operator would stand, to facilitate its use. This mechanism comprises an angle iron 60 which is brazed, or welded, to a pair of rearwardly extending posts 62 which are telescoped within tubular arms 64. The arms 64 are journaled, by trunnions 66, in pillow blocks 68 which are secured to vertical plates 70 extending upwardly from a plate 72. The plate 72, in turn, is secured to an angle bracket 74 which is secured to the main frame structure of the apparatus 10.

Reverting back to the angle iron 60, plates 76 extend rearwardly therefrom to provide supports for a pair of toggle clamps 78 which include adjustable clamping screws 80.

The mechanism described to this point provides the necessary flexibility for accommodating a wide variety of printing frame assemblies, as will be commonly found in the industry, and positioning them so that the lower surface of the silk screen can be accurately brought into parallel relation with workpieces of varying thickness as they are positioned on the supporting plates 28 at the printing station.

To briefly note the variable provided for, the rear rail of the frame assembly fr is to be gripped by the mechanism, with the remainder of the frame assembly projecting forwardly in cantilever fashion. First, the height of these rails is a variable which may be accommodated by adjustment of the screws 80. Next, the width and depth dimensions of the frame assembly may vary, or the placement of the design cut in the silk screen may not be central. These variations are accommodated by the position of the assembly along the length of the angle iron 60 and by the degree to which the posts 62 are telescoped within the arms 64. Screws 82 are provided to maintain this latter adjustment. Finally to obtain the desired parallel relationship between the bottom of the silk screen and the workpiece position on the plate 28, the entire assembly may be vertically adjusted by the position at which the angle bracket 74 is secured to the frame structure of the apparatus.

To facilitate these adjustments and also to provide a reference for the assembly in its printing position, adjustable screws 84 project upwardly from the horizontal plate 72 and are engaged by the arms 64 to limit clockwise movement of the assembly, in its operative or printing position.

As indicated, the silk screen assembly is pivoted between the printing position and an elevated position which permits cyclic operation of the conveyor 18. This pivotal movement is assisted by pneumatic spring means comprising an air motor 86 which his its cylinder end pivotally mounted by a pin 88 to a lug mount 90 secured to the plate 72 rearwardly of the pivot mounting of the arms 64 by the trunnions 66. The rod 92 of the air motor is pivotally connected by a pin 94 to a lug 96 which depends from a plate 98 spanning the arms 64. The rod end of the motor cylinder is connected to a pressurized air source through a valve 100 which controls the pressure in the rod end of the air motor.

The centers for the pivots 88 and 94 relative to the trunnions 66 provides an over the center arrangement wherein, when the frame assembly is in its printing position, there is a positive, pneumatic force holding the silk screen against a workpiece. Relatively little manual force is required to overcome the pneumatic force to lift the frame assembly and bring the pin 94 above the trunnions 66. Then the pneumatic force acts, with increasing torque, to assist in raising the frame assembly and ultimately becomes sufficient to maintain the frame assembly in an elevated position, permitting the operator to position a workpiece for the next printing operation. Counterclockwise movement of the assembly in its upper position is limited by engagement of one of the arms 64 with a limit switch 102. The switch 102 is adjustably mounted on one of the vertical plates 70 and serves the further function of controlling cyclic operation of the conveyor 18 as will later be described.

The holding station 14 requires no specific description. In some regards it is provided more for the convenience of enabling the operator to have sufficient "elbow room" at the printing station. However, it does give the operator an opportunity to inspect the results of the printing operation and make whatever adjustments might be appropriate before the workpiece is advanced to the "drying" station 16.

Figure 2:
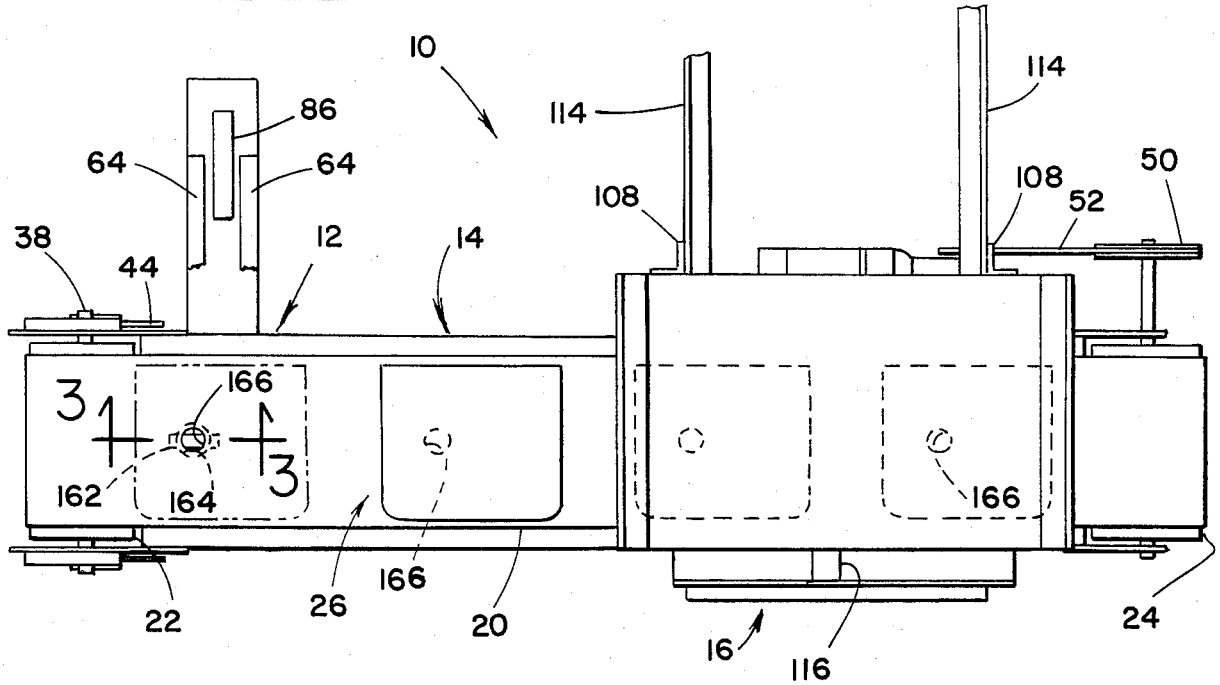
FIG. 2 is a plan view of the apparatus seen in FIG. 1.
Figure 5:
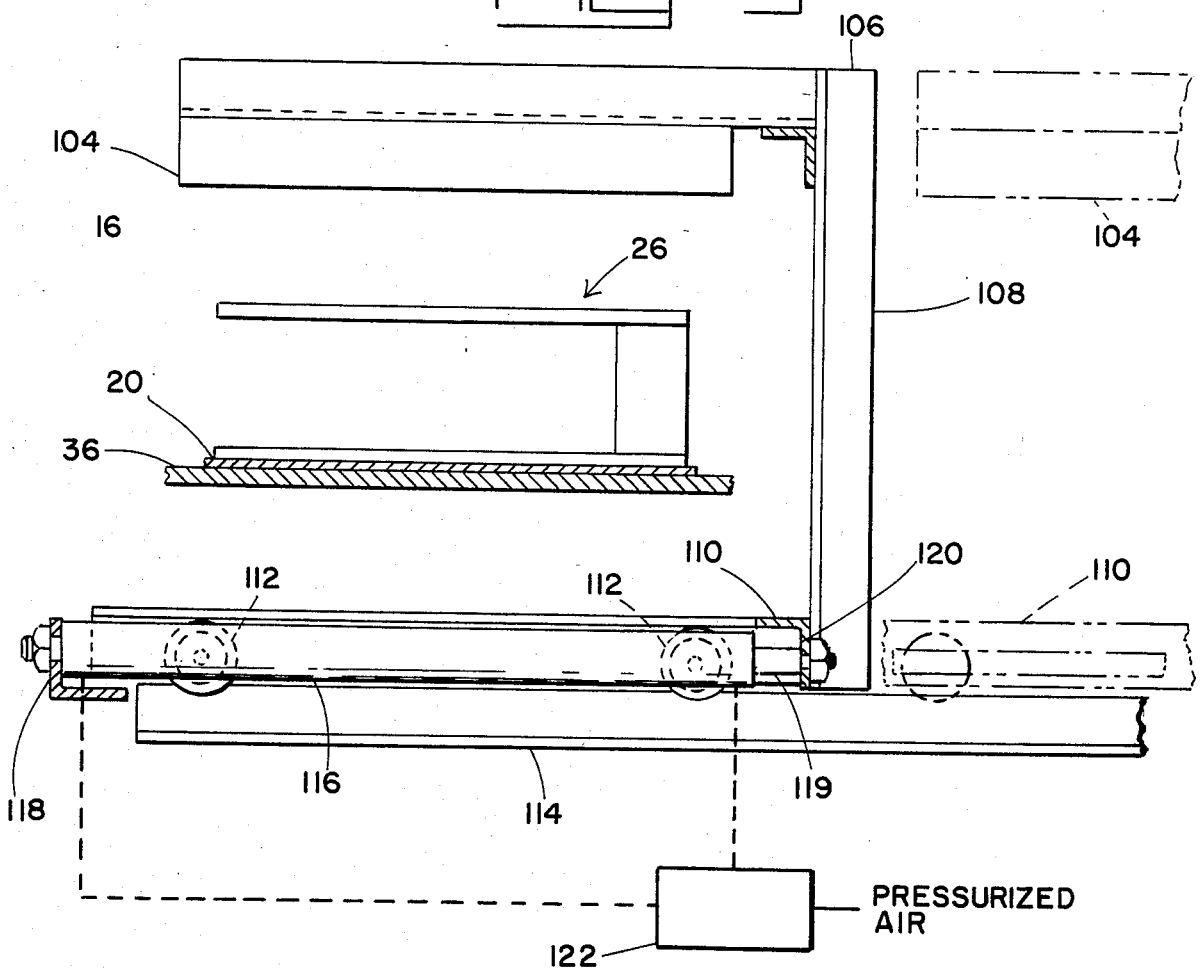
FIG. 5 is an end view, on an enlarged scale, of the "drying" station.

The "drying" station 16 comprises a heating element, indicated generally by reference character 104, see FIGS. 1, 2 and 5, which is spaced above the pedestals 26 as they advance along the upper run of the conveyor 18. The C-frame comprises a pair of upper angle irons 106, a pair of vertical angle irons 108 and a pair of lower angle irons 110. These pairs of angle irons are interconnected by several horizontal irons to provide structural rigidity as it particularly required to provid for rearward movement of the heater element.

A pair of rollers 112 is mounted on each of the lower angle irons 110. Each pair of rollers 112 ride, respectively, on the vertical flanges of angle irons 114 which are secured to the frame of the apparatus 10 and extend rearwardly thereof. The heater element 104 is thus mounted for movement from its illustrated operative position to a retracted position, indicated in phantom outline, rearwardly of the conveyor 18. This movement is controlled by an air motor 116, the cylinder end of which is secured to a horizontal angle rod 118 which is secured to the frame structure of the apparatus. The rod 119 of the air motor 116 is secured to a horizontal angle iron 120 which comprises part of the C-frame on which the heater element 104 is mounted. Pressurized air is selectively directed to opposite ends of the cylinder of the air motor 116 by means of a four way valve 122 to positively maintain the piston rod in its retracted position or its extended position in which the heater element is in an operative position. The manner of controlling the operation of the valve 122 will be later described.

Figure 8:
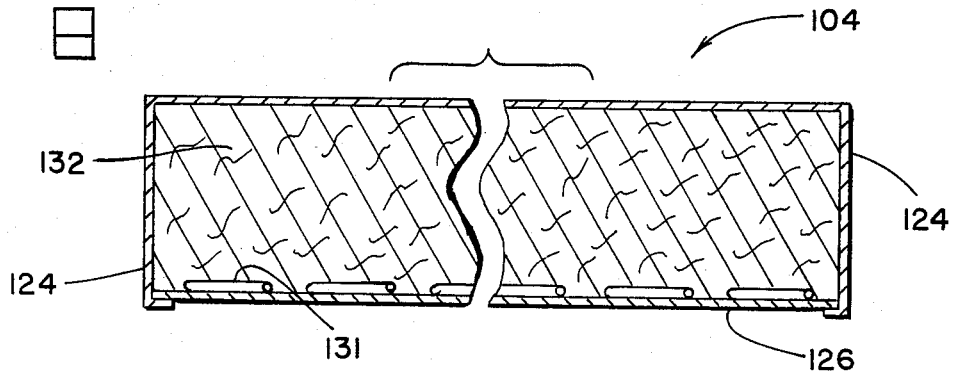
FIG. 8 is a cross section, on an enlarged scale, of a heater element employed herein.
Figure 9:
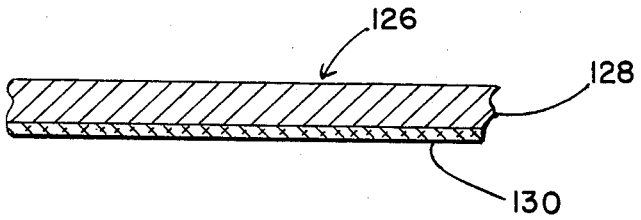
FIG. 9 is a section, of a further enlarged scale of an emission panel seen in FIG. 8.

The heater element 104 preferably comprises two independently controlled units 104*a* 104*b*, the construction of each being identical. Such construction is best illustrated in FIGS. 8 and 9. Sheet metal panels 124 form a box-like frame with a spectrally emission panel 126 forming its lower surface. The emissive panel 126 preferably comprises a stainless steel sheet 128, with a black; of metallic and non-metallic oxides coating 130 bonded to its lower surface. The characteristics of the coating system 130 will be further characterized below. Electric resistance elements 131, such as nichrome wires overlay the stainless steel sheet 128, being disposed so that, when energized, the sheet 128 will be heated in a substantially uniform manner. The remainder of the interior of the heating unit is restricted to that passing through the emission panel 126 for the purpose of "drying" designs printed on workpieces positioned therebeneath.

Figure 12:
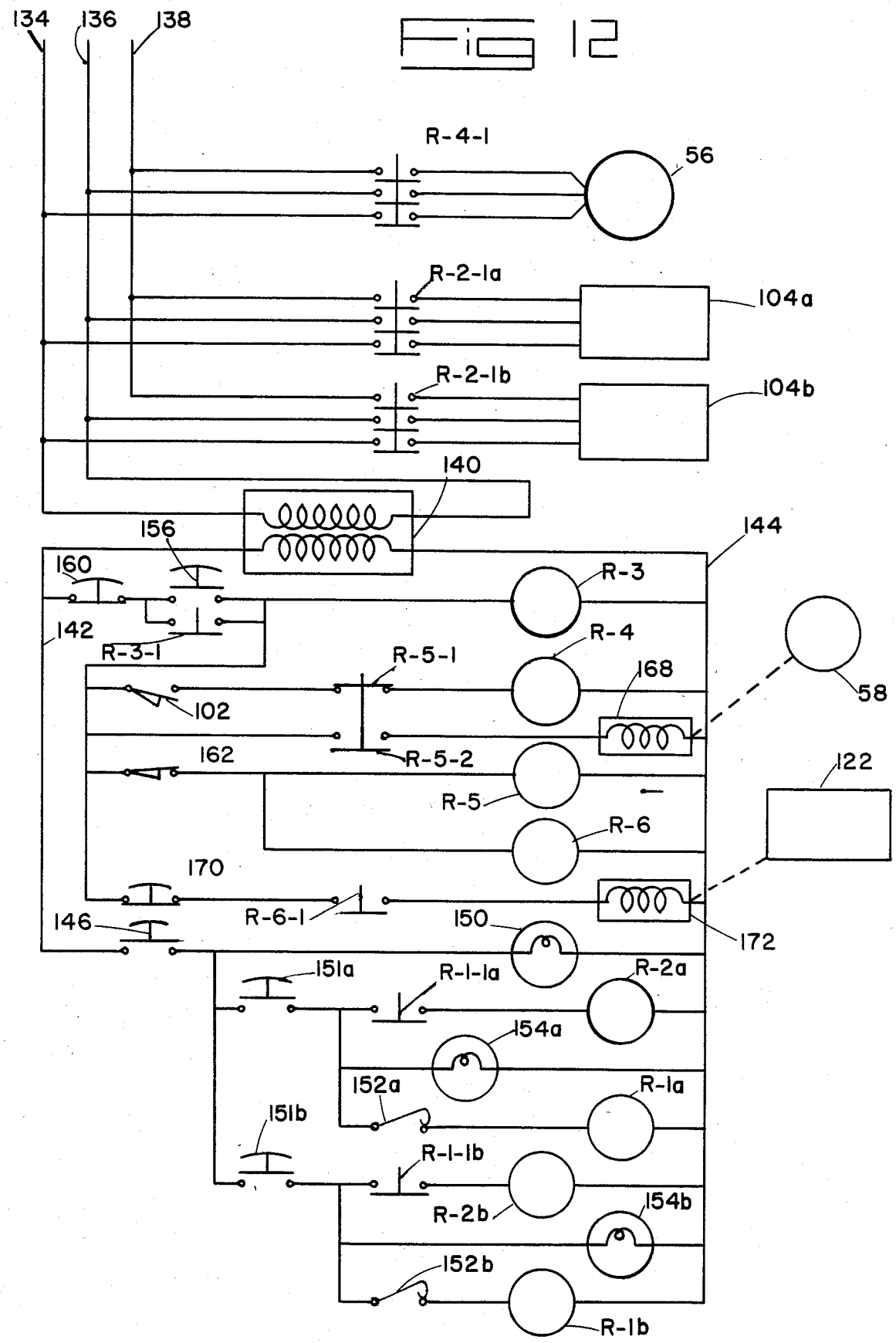
FIG. 12 is a schematic of the electrical and pneumatic components of the apparatus of the present invention.

Reference will next be made to FIG. 12 for a description of the electrical components employed herein. A three phase electrical power source is utilized, with power lines 134, 136 and 138. The lines 134 and 136 are connected to the input of a step down transformer 140 which provides a relatively low voltage potential across lines 142, 144 for the control circuitry.

In initiating operation of the apparatus, the heater units are first energized to bring them up to temperature. This is done by first closing a main heater switch 146 to energize the line 148, with the on condition being reflected by illumination of a lamp 105. The heater units 104*a* and 104*b* are separately controlled by identical controls and a description of one will suffice for the other. In the drawing the control components are differentiated by the letters a and b, but will herein be described without such differentiation. Thus, closure of switch energizes relay R-1 through a thermostat at 152. This causes closure of relay contact R-1-1 and energization of relay R-2, with the energized condition of the individual heater unit being reflected by illumination of a lamp 154. Energization of the relay R-2 causes closure of contacts R-2-1 to connect the heater unit across the power lines 134, 136 and 138. The thermostat, 152*a* and 152*b* are mounted on the heater units 104*a* and 104*b* and are adjustable to independently control the temperatures generated in those units by the resistance elements 131.

Operation of the remaining electrical components is initiated by momentary closure of a spring loaded start switch 156 to energize a relay R-3 and close hold-in contacts R-3-1, thereby energizing line 158 after release of the switch 156. A conventional, spring loaded stop switch 160 is connected in parallel with the switch 156 and contacts R-3-1 and may be momentarily depressed to deenergize the line 158.

Figure 3:
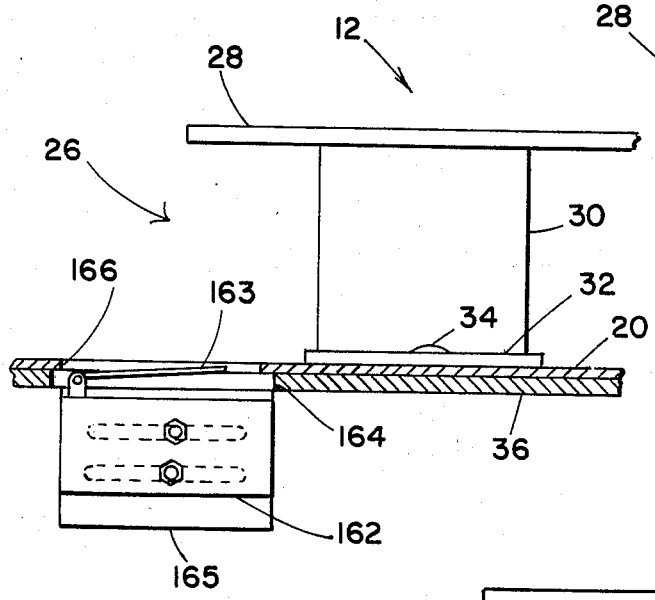
FIG. 3 is a view, on an enlarged scale, taken generally on line 3—3 in FIG. 2.
Figure 4:
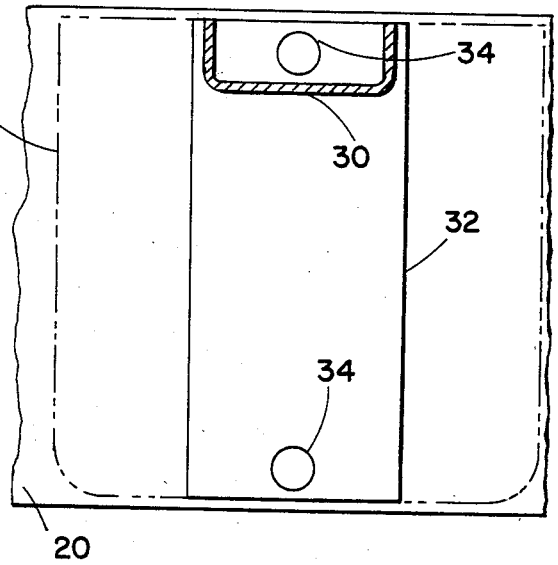
FIG. 4 is a plan view of a workpiece supporting pedestal seen in FIG. 3.

Before describing the circuits energized by closure of switch 156 reference will be made to FIG. 3 for a description of the means for sensing the incremental dwell position for the conveyor 18. A limit switch 162 is mounted beneath the belt supporting plate 36 adjacent the pulley 22 and has an actuating finger 163 which projects through an opening in the plate 36, indicated by reference character 164. The conveyor belt 20 has a plurality of holes 166 spaced along its length a distance equal to the desire incremental movement of the conveyor 18, namely a distance equally the spacing between the pedestals 26. The holes 166 are registerable with the opening 164 and when so registered permit the finger 163 to move to a raised position, wherein its contacts are open. Movement of the conveyor then causes the belt to depress the finger 163 and actuate the contacts of switch 162.

Reverting back to FIG. 12, there are four circuits connected across lines 158, 144. The first of these comprises limit switch 102 (which senses the raised position of the silk screen frame) relay contacts R-5-1 and relay R-4. The next circuit comprises relay contacts R-5-2 and a solenoid 168 which is mechanically connected to the motor brake 58. The third circuit comprises the conveyor position sensing switch 162 and parallel realys R-5 and R-6. The final circuit comprises an emergency stop switch 170, relay contacts R-6-1 and a solenoid 172 which is mechanically connected to the valve 122 for controlling air flow to the air motor 116 and the position of the heater element 104.

The relays R-5 and R-6 are of the fixed time of energization type. That is once energized they remain energized for a predeterminable length of time and then remain deenergized until reset by an interuption of current and reenergized. Thus, when relay R-5 would be energized upon the initial closing of switch 156, it would remain energized for a given time period and then deenergize until switch 162 was opened and subsequently reclosed to reset the relay for reenergization. Such relays are commonly known as time delay relays.

A detailed description of the operation of the present apparatus will now be given. Assuming that the heater units 104*a* and 104*b* are up to temperature the switch, 156 will be closed. Assuming also that the silk screen frame is in a raised position and the switch 102 closed, the contacts R-5-1 will open before the relay R-4 becomes energized. This is by reason of the fact that switch 162 (sensing the conveyor position) will be closed immediately energizing relay R-5. Energization of relay R-5 will also close contacts R-5-2 energizing solenoid 168 to actuate the brake 58 and positively prevent conveyor movement. Thus there is no conveyor movement immediately upon closing of the switch 156.

The operator will place a workpiece on the pedestal at the printing station, lower the silk screen frame and print a design on the workpiece. Upon lowering of the silk screen frame, the switch 102 opens preventing energization of the relay R-4 when the contacts R-5-1 close upon the completion of the energization cycle for the relay R-5. When the operator completes the silk screening of a design, he raises the silk screen frame, causing the switch 102 to close. If the timing cycle for the relay R-5 has run out, the contacts R-5-1 will be closed and relay R-4 will be energized to actuate movement of the conveyor 18. It is to be noted that the contacts R-5-2 will, at that time be open so that the brake 58 is released. Initial movement of the conveyor 18 results in the finger being depressed to open the switch 162. Movement of the conveyor 18 continues until the finger 63 enters the next hold 166 in the belt 20 causing the switch 162 to close. The relay R-5, by reason of the interruption of current to it, has been reset and is again energized for its fixed time period. The operator again lowers the silk screen frame and prints a design on a workpiece positioned on the pedestal now positioned at the printing station.

The switch 162 (see FIG. 3) is adjustably mounted on a bracket 165 longitudinally of the path of conveyor movement. This adjustment enables the dwell position of the conveyor to be accurately controlled to properly position the pedestals 26 at the printing station 12 and the "drying" station 16.

It will be seen that actuation of the conveyor advancing means is controlled by the rate of which the operator is able to silk screen designs on the workpieces, but subject to the limitation of a minimum dwell time for the conveyor between each cyclic advance, as determined by the energization time set for the relay R-5. This minimum dwell time is established by the residence time required in the "drying" station to "dry" or cure the printed designs.

The relay R-6 is provided to prevent over-exposure of the workpieces where, for one reason or another, the operator fails to print workpieces at a rate sufficient to remain within an allowable residence time of the workpieces at the "drying" station. The Relay R-6 becomes energized immediately upon closing of the switch 156, causing contacts R-6-1 to close and solenoid 172 to be energized. This causes the valve 122 to direct air to the motor 116 in a direction which maintains the heater element in its operative position. The time cycle of the relay R-6 is set greater than the time cycle of the relay R-5 and is determined by the maximum dwell time permissable for exposure of the workpieces to the radiation of the heater element. Thus if the conveyor 18 is advanced before expiration of the timing cycle for relay R-6, the current thereto will be interrupted (by opening of switch 162) resetting it to begin a new timing cycle when the switch 162 closes upon completion of an incremental advance of the conveyor. Therefore, if the operator does not exceed the maximum allowable time for the printing cycle, the contacts R-6-1 remain close, the solenoid 172 energized and the heater element 104 is stationary in its operative position at the "drying" station. If however, the maximum time is exceeded, the relay R-6 becomes deenergized, opening contacts R-6-1 and causing the heater element 104 to be retracted to prevent overexposure of the workpieces to the radiation from the heater element.

Experience has demonstrated that a normal printing cycle time is in the order of four to six seconds. It has also been determined that the minimum dwell time for "drying" designs printed with plastisol type inks is in the order of ten seconds, with a maximum time in order of 16 seconds being permissible without any damage to the textile workpieces on which the designs are printed.

With these parameters in mind, the timing cycle for the relay R-5 is set for five seconds and that for the relay R-6 at eight seconds. So long as the operator's printing cycle time does not exceed eight seconds, the heater element reamins in its operative position and the conveyor 18 is incrementally advanced with a minimum dwell time between each advancement of five seconds. The workpieces progress from the printing station 12, then to the holding station 14, then to a first position in the "drying" station 16, beneath the heating unit 104*a* and then to a second position within the "drying" station 16, beneath the heating element 104*b*. The next advancement of the conveyor 18 results in discharge of the finished workpieces which may be collected for whatever further operations are required in delivering them to a user.

The compactness of the present apparatus is further contributed to by the pedestal feature of the conveyor 18. In most silk screen operations the area occupied by the printed design represents but a small fraction of the overall area of the workpiece. As for example, it is a frequent practice to silk screen the name of a school over the breat pocket on a T-shirt or jacket. The workpeice supporting plates 28 of the pedestals 26 are sized for the larges anticipated design to be printed. The portions of the workpiece to be printed may be positioned on the plate 28 and the remainder of the workpiece then draped downwardly without interferring with the areas to be printed on adjacent workpieces. In other words, the pedestal feature enables a much closer spacing between workpieces than if they were layed flat on the conveyor. This is of particular significance in reducing the overall length of the "drying" station especially where, as here, it is contemplated that there will be two residence positions of the workpieces in the "drying" station.

Figure 10:
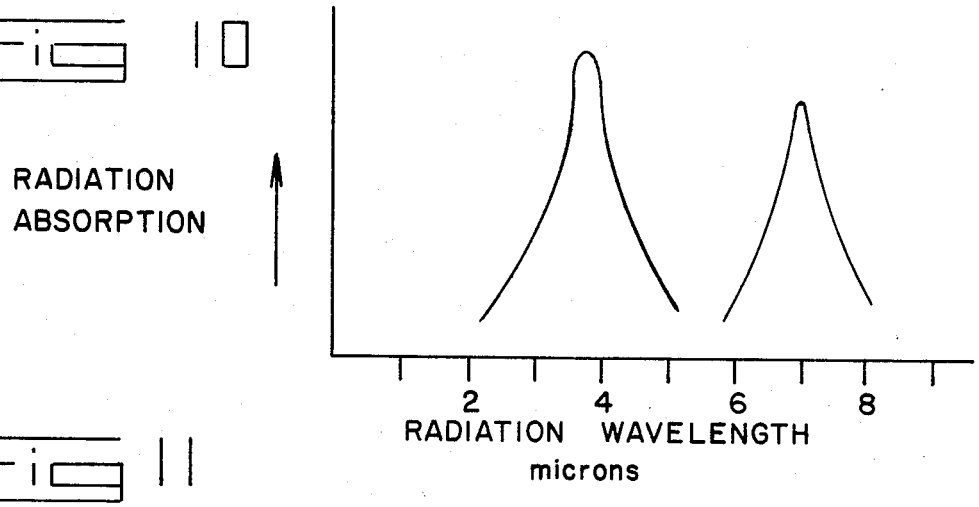
FIG. 10 is a graph depicting absorption characteristics of silk screen printing inks.

The "drying" cycle times referenced above are drastically shorter than obtained by the conventional equipment, and are attributable to the characteristics of the heater element 104. These characteristics are best understood by first referencing FIG. 10 which illustrates the radiation absorption characteristics of liquid vinyl co-polymers, from which silk screen ink is formulated and as previously been referenced as a plastisol type. It will be seen that this material exhibits two pronounced peaks, one at approximately four microns and the other at approximately seven microns. The significance of these curves is that infra-red radiation having a wave length of either four or seven microns is more readily absorbed by the liquid polymer, as opposed to being reflected. Energy of such wave lengths thus is highly effective, or efficient, in generating the internal heat required to effect polymerization of the co-polymer into a solid form. This internal heat is also effective in vaporizing the relatively small amount of solvents found in plastisol ink formulations.

Figure 11:
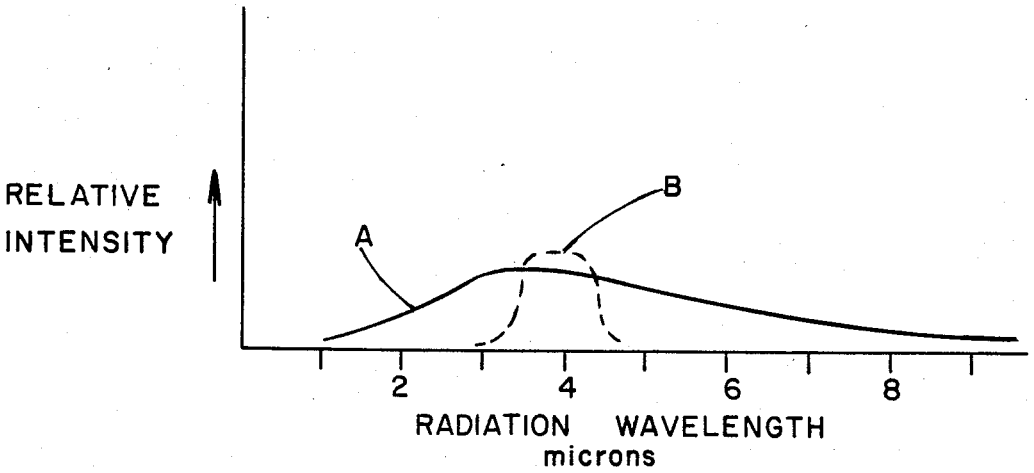
FIG. 11 is a graph depicting spectral emitting characteristics.

With this factor in mind, the spectrally selective characteristics of the heater element emissive surface become apparent, by referencing FIG. 11. Curve A represents the spectral distribution of a typical, non-luminous, infra-red heating element of the type previously employed to "dry" silk screen printed designs. It will be seen that the highest intensity of radiation is somewhat less than three microns and that the spectral range of radiation extends from as short as 1 micron and remains at significant levels beyond 10 microns. The area under curve A represents a quantum of energy, which for the most part, is not readily absorbed by the liquid polymer, as is apparent from FIG. 10, and therefore not effective in producing the heat necessary for polymerization.

Curve B in FIG. 11 represents the spectral distribution of infra-red radiation emitted from the heater element emission panel 126. It will be seen that essentially all of the radiant energy is concentrated in the spectral range of approximately three to four micron wavelength. Referencing again FIG. 10 it will be seen that the spectral range of the infra-red radiation from the heater element 104 closely matches the wavelengths which is most readily absorbed by the liquid co-polymer of the printing ink. Thus the energy generated, represented by the area under curve B is concentrated in the wavelength spectrum which can readily be absorbed by the liquid co-polymer, with a minimum being reflected and less readily absorb, and thus ineffective in polymerizing the ink to solid form.

The three to four micron range of infra-red radiation is generated at a relativel low temperature level, in the order of 600° to 1000° F. The function of the resistance heating wires 131 is to bring the metal sheet 128 uniformaly to that temperature level. The thermostats 152 are generally mounted remote from the sheet 128 and calibrate for the desired temperature.

The coating system 30 serves as a "window" to limit infra-red energy emitted to the three to four micron wavelength range. The formulation of coatings to serve such a "window" function are well known to those skilled in the art and comprising various metal oxides whose characteristics in such regards as known properties.

Another factor contributing to the efficiency of the present heater element is the preferred formulation of a coating 130 which is black in color. Black surfaces are demonstrably superior as energy emitters in the infra-red range of electromagnetic radiation.

In the "drying" of silk screened designs it has been found that the spacing of the emission panel 126 from the workpieces should be in the range of three to six inches, with a four inch spacing being prefered.

It will be apparent that the heater element contributes in many ways to the reduction in energy costs in addition to perhaps its most significant feature of reducing the time required to "dry" silk screen printed designs.

Many of these same advantages may be employed in fields other than the silk screen printing industry and beyond the art of printing with plastisol type inks. In this connection FIG. 6 is aginas refered to. While the characteristics depicted therein are specifically for liquid vinyl co-polymers of the type employed in silk screen printing, simiar absorption peaks will be observed in many other liquid monomers and co-polymers which can be converted to solid form when subject to an elevated temperature for a period of time.

Once these absorption peaks are determined, a heater element having a spectrally selective emissive surface limiting the infra-red radiation to the wavelength of such peak can be provided to obtain much shorter times for polymerizing, or curing, the liquid monomer or co-polymer to solid form, with the same attendant advantages of reducing energy requirements for the "drying" process. While, the present case, it was possible to readily match the spectrum of the wavelengths emitted by the heater to the most absorptive wavlength of the liquid co-polymer, namely three to four microns, significant advantages could also have been obtained had the emissive wave length been restricted to the seven micron range where a slightly lower absorption peak is found. This is to say that there may be materials which, for one reason or another it may be more practicable to match the spectral characteristics of the heater element to a secondary absorption peak in realizing the advantages of the present invention.

Having thus described the invention what is claimed as novel and desired to be secured by Letters Patent of the United States is:

1. Apparatus for the production of silk screened textile goods comprising:

a printing station at which silk screen designs are printed on successive workpieces, a "drying" station at which the printed designs are "dried", a conveyor for supporting the workpieces and having a run extending from the printing station to the "drying" station, means for incrementally advancing said conveyor with a minimum dwell period between each incremental advancement, whereby the workpieces may be positioned at the printing station and a design printed thereon while the conveyor is at rest and then advanced to the drying station for a minimum residence time thereat, the "drying" station comprising a heater element having means for generating and directing infra-red radiation in the spectrally limited range of three to four microns wave length toward the workpieces positioned on the conveyor, the printing station comprising means for holding a silk screen frame, said holding means being displacable from an operative position wherein the silk screen frame overlays a workpiece positioned on the conveyor for the printing of a design thereon, and an inoperative position in which the silk screen frame is spaced from the conveyer, means responsive to displacement of the holding means to its inoperative position for actuating the incremental advancing means for the conveyer, and means for terminating exposure of the workpieces to radiation from said heater element upon expiration of a predetermined maximum time for actuation of the means for incrementally advancing the conveyer, the heater element being mounted above the conveyer and spaced from the workpieces thereof and being displacable from an operative position in which its radiant energy is directed towards the conveyer and an inoperative position laterally of the conveyor wherein no more than a minimal portion of such radiation is directed towards the conveyer and the workpieces positioned thereon, the means for terminating exposure of the workpieces to radiation including means for displacing the heater element from its operative to its inoperative position.

2. Apparatus for the production of silk screened textile goods as in claim 1 wherein the conveyer comprises an endless belt having pedestals spaced apart along its length, said pedestals having upper surfaces on which the workpieces are placed at the printing station and which support the workpieces as they are advanced to and through the "drying" station.

3. Apparatus for the production of silk screened textile goods as in claim 1 further comprising means responsive to displacement of the silk screen holding means to its inoperative position for returning the heater element to its operative position when the maximum time for actuation of the means for incrementally advancing the conveyor is exceeded.

4. Apparatus for the production of silk screened textile goods as in claim 1 wherein the conveyor comprises an endless belt having pedestals spaced apart along its length, said pedestals having upper surfaces on which the workpieces are positioned at the printing station and which support the workpieces as they are advanced to and through the "drying" station, and the means for holding a silk screen frame include an arm pivotally mounted about an axis spaced to one side of the conveyor and parallel to the path of movement of the conveyor, said arm having clamping means at its outer end for gripping one rail of a silk screen frame so that the frame extends in cantilever fashion towards the conveyor.

5. Apparatus for the production of silk screened textile goods as in claim 4 wherein means are provided for varying the effective length of said arm to obtain a desired position of the silk screen frame laterally of the conveyor, the clamping means comprise a lower angle member for receiving the rail of the silk screen frame and toggle clamps engagable with the upper surface of the frame rail to hold it against the angle member, said toggle clamps having adjustable pressure members to accommodate frame rails of varying thickness.

6. Apparatus for the production of silk screened textile goods as in claim 4 wherein the printing station further comprises over-the-center resilient means for providing a force yieldingly holding the silk screen against a pedestal supported workpiece in the printing position of the holding means and maintaining the holding means in its inoperative position when it is swung thereto by manual displacement by an operator.

7. Apparatus for the production of silk screened textile goods as in claim 6 wherein the resilient over-the-center means comprise a cylinder and piston pressurized by air to provide the resilient force.

8. Apparatus for producing silk screened textile goods as in claim 7 further comprising means for vertically adjusting the frame holding means to obtain parallel engagement between the bottom of the silk screen and the workpieces positioned on the pedestals.

9. Apparatus for the production of silk screened textile goods as in claim 1 wherein the conveyor comprises an endless belt having pedestals equally spaced apart along its length, said pedestals having upper surfaces on which the workpieces are positioned at the printing station and which support the workpieces as they are advanced to and through the "drying" station, and further comprising means for sensing advancement of the conveyor a distance equal to the spacing between pedestals, and means responsive to the sensive of such advancement for deenergizing the conveyor advancing means thereby providing for each incremental advancement of the conveyor to be equal to the spacing between the pedestals.

10. Apparatus for the production of silk screened textile goods as in claim 9 wherein the means for sensing advancement of the conveyor include an opening in said belt adjacent to each of the pedestals and a switch which is actuated by the movement of an opening therepast, said switch being adjustable relative to the path of travel of the belt to accurate position the pedestals at the printing station and the drying station.

11. Apparatus for the production of silk screened textile goods as in claim 1 wherein the conveyor comprises an endless belt having pedestals equally spaced along its length, said pedestals having upper surfaces on which the workpieces are positioned at the printing station and which support the workpieces as they are advanced to and through the "drying" station, a pair of pulleys around which the belt is trained in forming its upper run, and further comprising support means disposed beneath and maintaining the upper run of the conveyor in a horizontal plane.

12. Apparatus for the production of silk screened textile goods as in claim 11 wherein each pedestal of the conveyor comprises a base plate secured to the belt by fasteners disposed on a line normal to the path of conveyor movement, and upright member projecting upwardly from the base plate and having a vertical outline of relatively small lateral extent and a workpiece supporting plate atop the upright having a surface area equalling the area of the largest design to be printed, said upright being offset to the side of the conveyor remote from that where the operator is positioned at the printing station.

13. Apparatus for the production of silk screened textile goods as in claim 1 wherein the heater element comprises a unit which includes a box-like frame having a lower, spectrally selective emission panel, electrically resistance means for substantially uniformaly heating said panel, said heating means being disposed above said panel with the remainder of the box-like frame being filled with insulation to substantially restrict radiation of energy from the unit to that passing through the emission panel.

14. Apparatus for the production of silk screened textile goods as in claim 13 wherein the emission panel comprises a metal sheet having a black coating of metallic and non-metallic oxides which selectively transmits infra-red radiation substantially limited to the wave length range of three to four microns, said emission panel being spaced between three and six inches from the printed portions of the workpieces at the "drying" station.

15. Apparatus for the production of silk screened textile goods as in claim 14 wherein the emission panel is spaced approximately four inches from the printed positions of the workpieces.

16. Apparatus for the production of silk screened textile goods as in claim 13 wherein the "drying" station comprises two heater units in side by side relation along the length of the conveyor, the means for incrementally advancing the conveyor to successively position workpieces beneath the first unit and then establishing the desired energy level for each.

17. Apparatus for the production of silk screened textile goods as in claim 1 wherein the conveyor comprises a endless belt having pedestals equally spaced along its length, a pair of pulleys around which the belt is trained at opposite ends of its upper, horizontal run, said pedestals having upper surfaces on which the workpieces are positioned at the printing station and which support the printed portions of the workpieces in a horizontal plane as they are advanced to and through the "drying" station, the heater element comprises a box-like frame having a lower, spectrally selective emission panel, electrical resistance means for substantially uniformaly heating said panel to a temperature in the range of 600° to 1000° F., said heating means being disposed above said panel with the remainder of the box-like frame being filled with insulation to substantially restrict radiation of energy from the element to that passing through the emission panel, said emission panel being disposed in a horizontal plane and having a lateral dimension approximating that of the workpiece supporting surfaces of the pedestals and a length approximating that of the distance between two pedestals, and the means for incrementally advancing the conveyor advance it a distance equal to the distance between pedestals on each actuation, whereby the workpieces are subject to the infra-red radiation of the heater element for two cycles of operation of the conveyor.

18. Apparatus for the production of silk screened textile goods as in claim 17 wherein the printing station is spaced from the "drying" station a distance equal to the distance between two pedestals, thereby providing a holding station for inspection of the printed articles before they are advanced to the "drying" station.

* * * * *